US008240504B2

(12) United States Patent
Fallen

(10) Patent No.: US 8,240,504 B2
(45) Date of Patent: Aug. 14, 2012

(54) CONTAINER LID WITH PRINTABLE RIM

(75) Inventor: Raymond J. Fallen, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 375 days.

(21) Appl. No.: 12/544,928

(22) Filed: Aug. 20, 2009

(65) Prior Publication Data

US 2011/0042379 A1 Feb. 24, 2011

(51) Int. Cl.

| | |
|---|---|
| ***B65D 51/00*** | (2006.01) |
| ***B65D 41/16*** | (2006.01) |
| ***B65D 41/18*** | (2006.01) |
| ***B65D 43/03*** | (2006.01) |
| ***B65D 43/06*** | (2006.01) |
| ***B65D 21/00*** | (2006.01) |

(52) U.S. Cl. ..... 220/780; 220/376; 220/781; 220/782; 220/783; 215/206; 215/230; 206/508

(58) Field of Classification Search ..... 220/376, 220/780, 781, 782, 783; 215/206, 230; 206/508
See application file for complete search history.

(56) References Cited

U.S. PATENT DOCUMENTS

| | | | | |
|---|---|---|---|---|
| 7,318,536 | B2 | 1/2008 | Maravich et al. | |
| 2001/0047994 | A1 * | 12/2001 | von Holdt, Jr. | 220/276 |
| 2006/0124643 | A1 * | 6/2006 | Markert et al. | 220/254.3 |
| 2007/0187407 | A1 | 8/2007 | Driskill et al. | |
| 2007/0205196 | A1 * | 9/2007 | Burney et al. | 220/276 |
| 2008/0017651 | A1 | 1/2008 | Walker et al. | |

* cited by examiner

*Primary Examiner* — Anthony Stashick
*Assistant Examiner* — Madison L Wright
(74) *Attorney, Agent, or Firm* — Barnes & Thornburg LLP

(57) ABSTRACT

A canister includes a closure coupled to a container to close a mouth opening into an interior region formed in the container. The closure includes a lid having a plate and a rim extending around the plate.

21 Claims, 6 Drawing Sheets

CONTAINER LID WITH PRINTABLE RIM

BACKGROUND

The present disclosure relates to canisters, and in particular to lids for mounting on the top of containers. More particularly, the present disclosure relates to a rim of a container lid.

SUMMARY

A canister in accordance with the present disclosure includes a container and a container closure. The container closure is configured to mate with a brim of the container to close an opening formed in the container and defined by the brim.

In illustrative embodiments, the container closure includes a lid having a cover plate and a rim around the cover plate. The container closure also includes a lid mount coupled to the rim and configured to mate with the brim of the container.

The rim includes a beveled message board formed to include an inclined exterior surface carrying a printed message thereon. In illustrative embodiments, the rim includes a beveled first message board on one side of the lid and a beveled second message board on an opposite side of the lid.

In illustrative embodiments, the rim of the lid also includes two fenders. A first fender interconnects first ends of each of the first and second message boards while an opposing second fender interconnects second ends of each of the first and second message boards. Each fender includes a C-shaped basin-stacking skirt extending upwardly from the cover plate of the lid. The two basin-stacking skirts are arranged to lie in spaced-apart relation to one another on the cover sheet to form a container-receiving receptacle therebetween sized to receive the container of a canister stacked on top of the lid.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
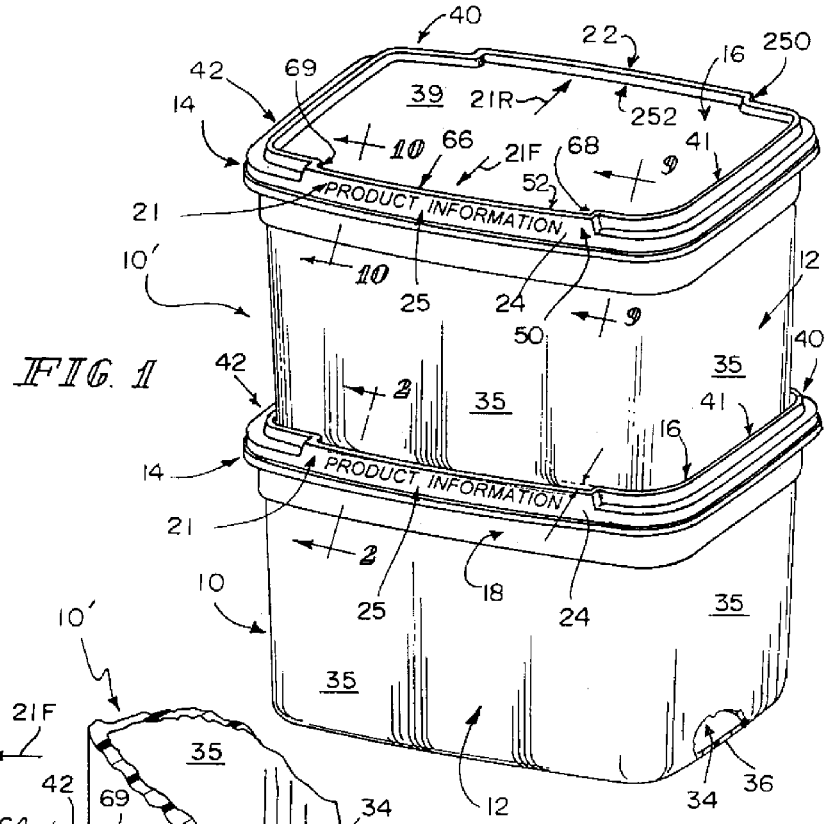
FIG. 1 is a perspective view of a stack of canisters in accordance with the present disclosure and showing that each canister includes a container and a lid mounted on the container and configured to include a beveled front message board along a perimeter edge of the lid.

A pair of stacked canisters 10, 10' is shown, for example, in FIG. 1. Each canister 10, 10' includes a container 12 and a closure 14 comprising a lid 16 and a lid mount 18. Canisters 10, 10' are identical in size and shape to one another. Each lid 16 in illustrative embodiments is configured to display product information associated with product stored in a companion container 12 and to facilitate support of a canister stacked on top of lid 16.

Figure 3:
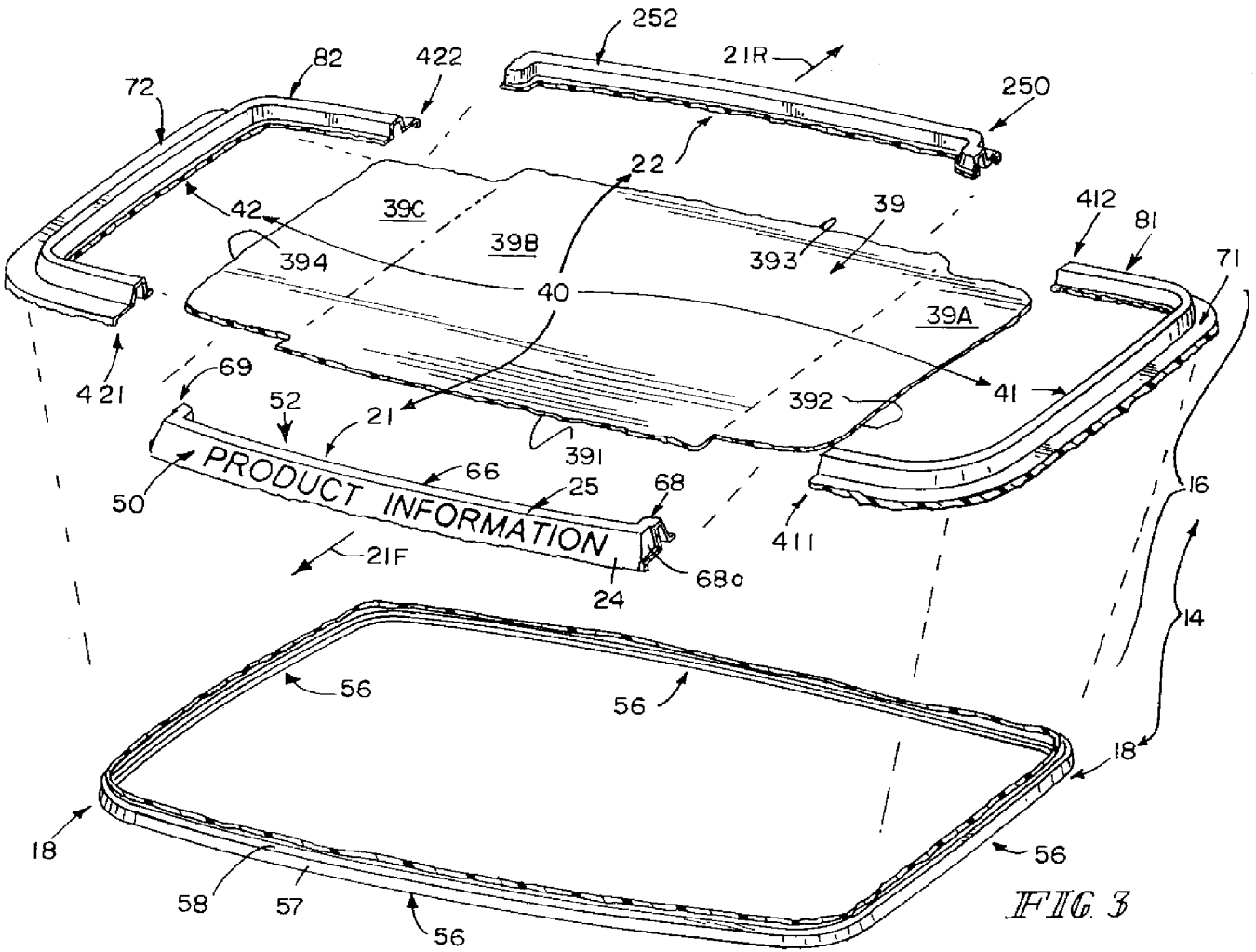
FIG. 3 is an exploded perspective diagrammatic view of the lid mounted on each of the containers shown in FIG. 1 showing that the lid includes a closure comprising a horizontally extending basin-support plate, a front message board associated with a front edge of the basin-support plate, a separate back message board associated with a back edge of the basin-support plate, a first fender associated with a left-side edge of the basin-support plate and adapted to mate with a left-side portion of the brim of a companion container, and a second fender associated with a right-side edge of the basin-support plate and adapted to mate with a right-side portion of the brim of the companion container, and an endless closure mount adapted to mate with lower edges of the front message board, first fender, back message board, and second fender and configured to mate with the out-turned brim of an underlying container to retain the closure in a mounted position on the container.
Figure 4:
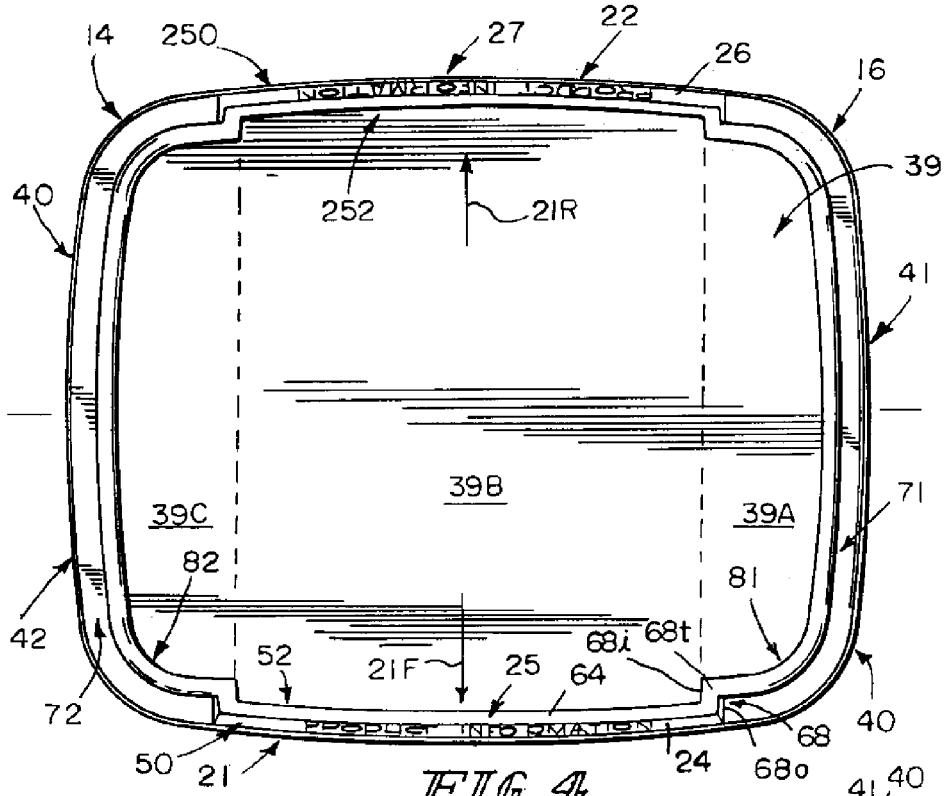
FIG. 4 is a top plan view of the lid of FIG. 1 showing the spaced-apart front and back message boards.

Each lid 16 is formed to include a first message board 21 facing in a forward direction 21F and providing a positively sloping inclined exterior surface 24 carrying a first printed message 25 and a second message board 22 facing in a rearward direction 21R and providing a negatively sloping inclined exterior surface 26 carrying a second printed message 27 as suggested in FIGS. 1, 3, and 4. Each of first and second message boards 21, 22 is beveled to incline companion exterior surfaces 24, 26 to enhance visibility of messages carried on exterior surfaces 24, 26.

Figure 2:
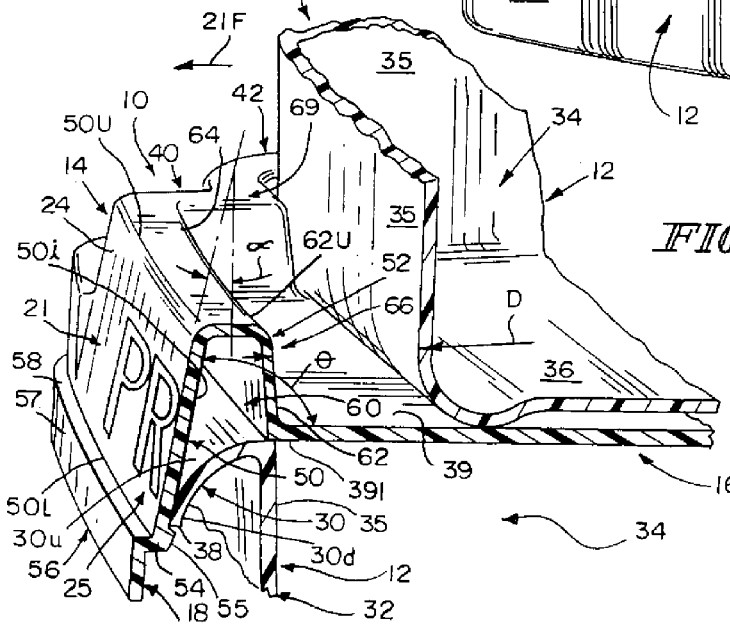
FIG. 2 is an enlarged perspective view of the canisters of FIG. 1, with portions broken away, showing that the front message board of the lower lid includes a forwardly facing display panel, a rearwardly facing support panel, and a horizontally extending top panel interconnecting top edges of the display and support panels, the front message board is arranged to lie above a portion of an out-turned brim included in the container, and the lid further includes a lid-removal blocker coupled to a lower edge of the front message board and arranged to engage a downwardly facing surface on the out-turned brim normally to retain the lid in a mounted position on the container.

Fenders 41, 42 included in lid 16 of canister 10 are configured retain a container 12 in a canister 10' stacked on top of lid 16 in an aligned position as suggested in FIGS. 1 and 2 to enhance stackability of canisters 10, 10'. For example, a bottom portion of container 12 included in canister 10' lies somewhat snugly in a nest or receptacle formed in lid 16 of underlying canister 10 between first and second fenders 41, 42 as suggested in FIGS. 1 and 2.

Container 12 includes a brim 30 and a basin 32 coupled to brim 30 as shown, for example, in FIGS. 1 and 2. Closure 14 is configured to mate with brim 30 of container 12 to hold closure 14 in a stationary position on container 12 so that both of the beveled first and second message boards 21, 22 are visible to nearby observers. It is within the scope of this disclosure to adapt lid 16 to mate with a container of any suitable shape and size.

Basin 32 is formed to include an interior product-storage region 34 as suggested in FIGS. 1 and 2. In an illustrative embodiment, basin 32 includes four upstanding side walls 35 and a floor 36 coupled to lower edges of side walls 35.

Brim 30 is endless and is coupled to upper edges of side walls 35 as suggested in FIG. 2. Brim 30 is formed to define a mouth opening into interior product-storage region 34 formed in container 12 as suggested in FIG. 2. In illustrative embodiments, brim 30 has a curved cross-sectional shape and is cantilevered to the upper edges of side walls 35 to cause a convex exterior surface 30*u* to face upwardly away from basin 32 and a concave exterior surface 30*d* to face downwardly toward basin 32 as suggested in FIG. 2. Brim 30 turns outwardly and terminates at an endless outer edge 38 that extends around and lies in spaced-apart relation to basin 32 in an illustrative embodiment.

Lid 16 includes a cover plate 39 and a rim 40 coupled to a perimeter portion of cover plate 39 as suggested in FIGS. 3 and 4. In illustrative embodiments, rim 40 is endless and includes, in series, first message board 21, first fender 41, second message board 22, and second fender 42 as suggested in FIGS. 3, 4, and 7. The underside of rim 40 is formed to include a downwardly opening channel 90 as shown, for example, in FIG. 8. Rim 40 further includes rigidifying webs 91-98 located in that channel 90 and configured to rigidify lid 16 of closure 14 as suggested in FIG. 8.

Lid mount 18 of closure 14 is arranged to underlie and couple to each of first and second message boards 21, 22 and first and second fenders 41, 42 as suggested in FIG. 3. In illustrative embodiments, lid mount 18 is endless and is configured to mate with endless brim 30 to retain lid 16 at the pleasure of a user in a stationary position on basin 32 closing the open mouth defined by brim 30 as suggested in FIGS. 1-3.

As suggested in FIG. 3, first message board 21 is coupled to a first section 391 of the perimeter portion of cover plate 39, first fender 41 is coupled to a second section 392 of the perimeter portion of cover plate 39, second message board 22 is coupled to a third section 393 of the perimeter portion of cover plate 39, and second fender 42 is coupled to a fourth section 394 of the perimeter portion of cover plate 39. In the illustrated embodiment, sections 391-394 of the perimeter portion are continuous and uninterrupted as suggested in FIG. 3.

Figure 7:
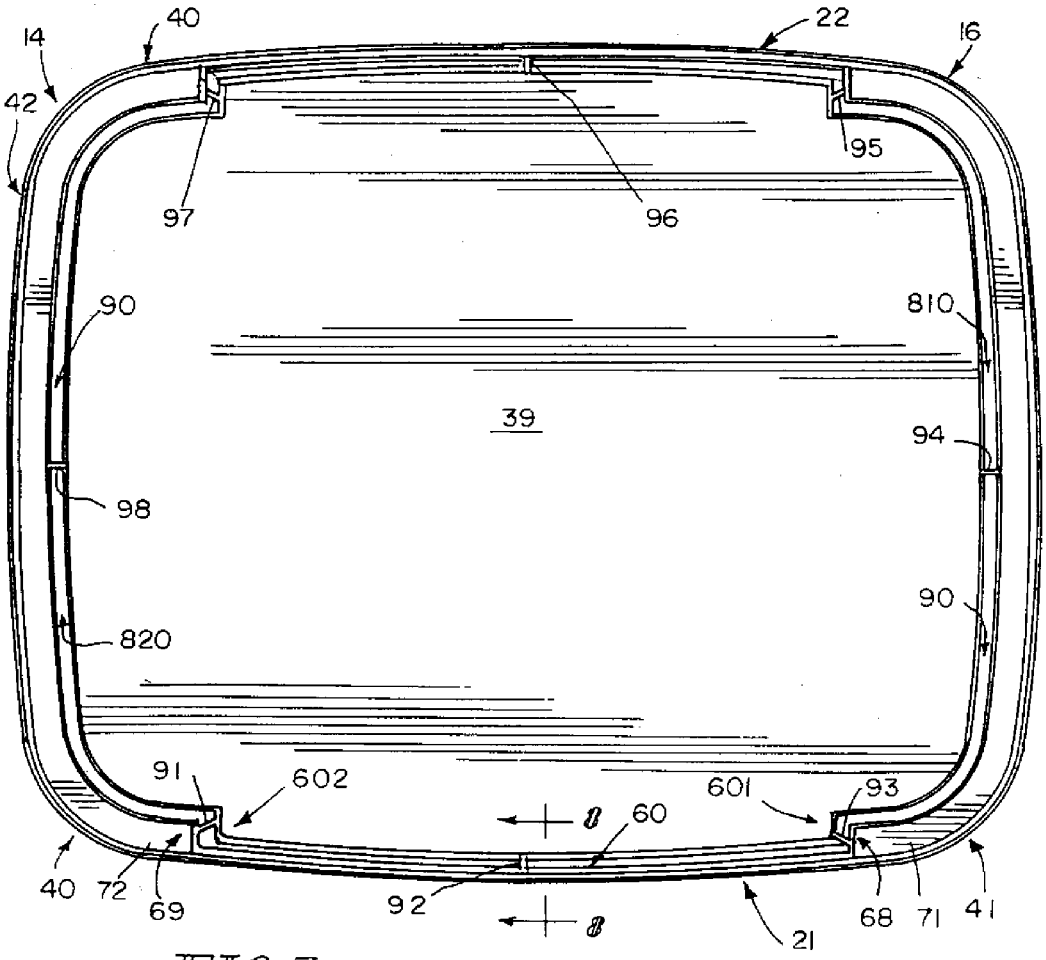
FIG. 7 is a bottom view of the lid of FIGS. 4-6 showing the underside of the first fender (at the bottom of FIG. 7), the underside of the second fender (at the top of FIG. 7), and the underside of the basin-support plate located between the first and second fenders and showing eight spaced-apart rigidifying webs arranged to lie in web-receiving channels formed in each of the first and second fenders and the front and back message boards.

In illustrative embodiments, each of first and second message boards 21, 22 and first and second fenders 41, 42 is C-shaped as suggested in FIGS. 3 and 4. First message board 21 interconnects first ends 411, 421 of first and second fenders 41, 42 while second message board 22 interconnects second ends 412, 422 of first and second fenders 41, 42 to establish endless rim 40 of lid 16 as also suggested in FIGS. 3 and 4 and to form endless channel 90 on the underside of lid 16 as shown in FIG. 7. Also in the illustrated embodiment, cover plate 39, first and second message boards 21, 22, first and second fenders 41, 42, and lid mount 18 cooperate to form a monolithic closure 14 made of a translucent plastics material.

First message board 21 extends along first section 391 of the perimeter portion of cover plate 39 and includes a display panel 50 and a display-panel support 52 as suggested in FIGS. 2 and 3. Second message board 22 has a similar construction and will therefore not be described in great detail herein.

Display panel 50 of first message board 21 is arranged to lie in spaced-apart relation to first section 391 of the perimeter portion of cover plate 39 as shown, for example, in FIGS. 2 and 3. Display panel 50 includes inclined exterior surface 24 as suggested in FIGS. 1 and 2. Any suitable product information can be printed directly on inclined exterior surface 24 as suggested in FIGS. 1-3 or printed on a label that is affixed to inclined exterior surface 24 to establish first printed message 25 on first message board 21.

Display-panel support 52 of first message board 21 is coupled to display panel 50 and to cover plate 39 as suggested in FIG. 2. Display-panel support 52 is configured to provide means for supporting display panel 50 in a reclined position relative to cover plate 39 wherein an upper edge 50U of display panel 50 lies in closer proximity to basin 32 of container 12 than a lower edge 50L of display panel 50 as suggested in FIG. 2 to cause display panel 50 to cooperate with the upwardly facing top surface of cover plate 39 to define an acute included angle θ therebetween when rim 40 of the lid 16 is mated with brim 30 of the container 12 so that a printed message 25 provided on an inclined exterior surface 24 of display panel 50 arranged to face away from cover plate 39 is visible to an observer. In an illustrative embodiment, inclined exterior surface 24 is also arranged to lie at an acute angle α with respect to a vertical reference line as suggested in FIG. 2.

Lid mount 18 is coupled to lower edge 50L of display panel. Lid mount 18 is configured to mate with brim 30 and lie in spaced-apart relation to 50 as suggested in FIGS. 2 and 3 basin 32 of container 12 while an interior surface 50*i* of display panel 50 arranged to face toward basin 32 engages brim 30 of container 12 to retain cover plate 39 in a stationary position on container 12 closing the mouth defined by brim 30 as shown, for example, in FIG. 2. Brim 30 is arranged to lie in a space provided under display panel 50 and between lid mount 18 and first section 391 of the perimeter portion of cover plate 39 when rim 40 of the lid 16 is mated with brim 30 of container 12 as suggested in FIG. 2.

Figure 11:
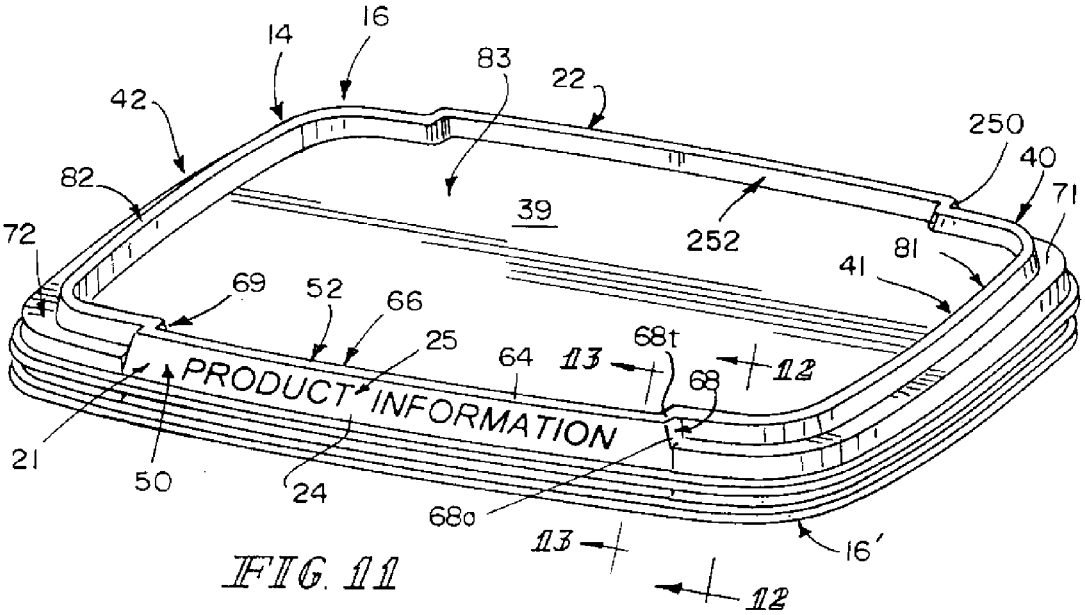
FIG. 11 is a perspective view of the two lids shown in FIG. 1 in a lid stack before the lids were separated from one another and mounted on the containers shown in FIG. 1.
Figure 12:
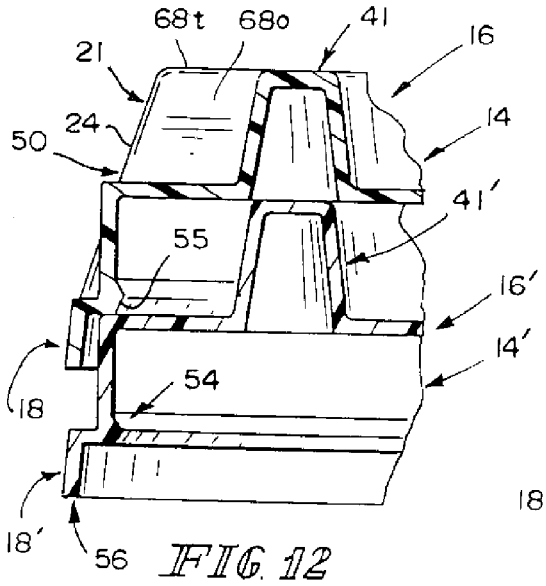
FIG. 12 is an enlarged sectional view taken along line 12-12 of FIG. 11.
Figure 13:
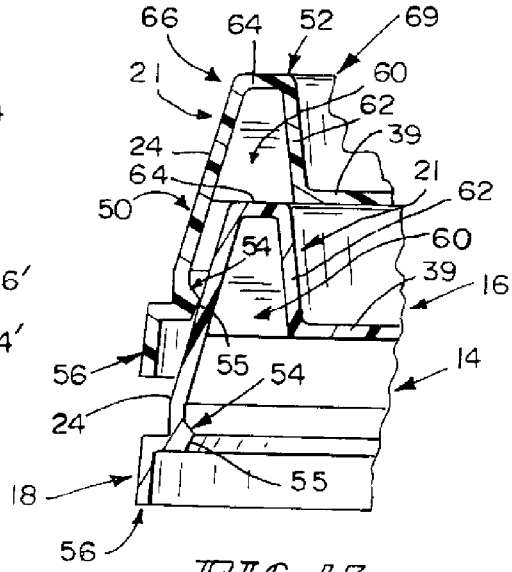
FIG. 13 is an enlarged sectional view taken along line 13-13 of FIG. 11.

Lid mount 18 includes a lid-removal blocker wall 54 coupled (e.g., cantilevered) to lower edge 50L of display panel. Lid-removal blocker wall 54 is arranged to extend toward basin 32 of container 12 to lie under and mate with a downwardly facing terminal end 38 of brim 30 as also shown in FIG. 2. Lid-removal blocker wall 54 also includes a terminal end 55 that is arranged to mate with an inclined exterior surface 24 of a first message board 21 of an underlying canister to provide stand-off means for vertically separating a pair of stacked lids 16, 16' as suggested in FIGS. 11 and 13 so that the first message board 21 of underlying lid 16 does not become stuck or otherwise wedged in a downwardly opening chamber 60 in channel 90 formed in the first message board 21 of overlying lid 16.

Figure 8:
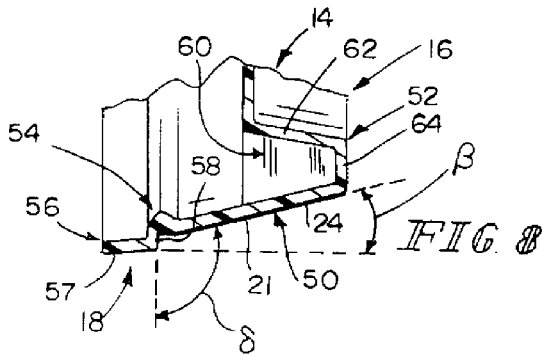
FIG. 8 is a sectional view taken along line 8-8 of FIG. 7 showing a trapezoidal shape of the rigidifying web lying in a web-receiving channel formed between the display and inner panels of the front message board.

Lid mount 18 further includes a lid-removal flange 56 coupled to lid-removal blocker wall 54 as suggested in FIGS. 2 and 8. Lid-removal flange 56 is arranged to extend downwardly away from display panel 50. Lid-removal flange 56 is configured to include a downwardly extending, outwardly facing side wall 57 and an outwardly extending, upwardly facing top wall 58. Downwardly extending, outwardly facing side wall 57 is oriented to cooperate with inclined exterior surface 24 of display panel 50 carrying first printed message 25 to define an acute included angle 13 therebetween as suggested in FIG. 8. Outwardly extending, upwardly facing top wall 58 is oriented to cooperate with inclined exterior surface 24 of the display panel 50 to define an obtuse included angle δ therebetween as suggested in FIG. 8.

Display-panel support 52 cooperates with display panel 50 to form a downwardly opening chamber 60 as suggested in FIGS. 2, 7, 10, 12, and 13. Brim 30 extends upwardly into downwardly opening chamber 60 when rim 40 of lid 16 is mated with brim 30 of container 12 as shown, for example, in FIGS. 2 and 10. Chamber 60 is part of channel 90 formed on the underside of lid 16 as suggested in FIG. 7.

Display-panel support 52 further includes an inner panel 62 coupled to first section 391 of the perimeter portion of cover plate 39 as suggested in FIG. 2. Inner panel 62 is arranged to lie in laterally spaced-apart relation to display panel 50 in an inclined position to cause display panel 50 and inner panel 62 to cooperate to form an acute included angle Δ therebetween as suggested in FIG. 10. Inner panel 62 is arranged to cooperate with cover plate 39 to form an obtuse included angle Ø therebetween as also suggested in FIG. 10. Inner panel 62 is arranged to lie in spaced-apart relation to a side wall 35 of a basin 32 in a container 12 of a canister 10' stacked on top of lid 16 of canister 10 so that a distance D separates inner panel 62 and side wall 35 as shown, for example, in FIG. 2.

In illustrative embodiments, each of display and inner panels 50, 62 of first message board 21 are bow-shaped along lengths thereof as shown best in FIG. 4 to cause inclined exterior surface 24 of display panel 50 to have a convex shape facing away from cover plate 39 and inner panel 62 to have an exterior surface facing away from display panel 50 and having a concave shape. It is within the scope of this disclosure to provide each of display and inner panels 50, 62 with suitable non-bowed shapes.

Display-panel support 52 further includes a top panel 64 arranged to interconnect upper edge 50U of display panel 50 and an upper edge 62U of inner panel 62 as suggested in FIG. 2. Top panel 64 cooperates with display and inner panels 50, 62 to define downwardly opening chamber 60 included in channel 90 as suggested in FIG. 10. Brim 30 extends upwardly into downwardly opening chamber 60 to lie in spaced-apart relation to top panel 64 when rim 40 of the lid 16 is mated to brim 30 of container 12 as shown, for example, in FIG. 10.

As suggested in FIG. 3, cover plate 39 includes a first generally D-shaped section 39A coupled to first fender 41, a second generally D-shaped section 39C coupled to second fender 42, and a generally rectangular section 39B coupled to each of first and second message boards 21, 22 and arranged to lie between and interconnect first and second generally D-shaped sections 39A, 39C as suggested in FIGS. 3 and 4. Cover plate 39 is a monolithic thin sheet in an illustrative embodiment.

Second message board 22 is arranged to extend along third section 391 of the perimeter portion of cover plate 39 as suggested in FIG. 3. Second message board 22 includes a second display panel 250 arranged to lie in spaced-apart relation to third section 391 of the perimeter portion and a second display-panel support 252 coupled to second display panel 250 and to cover plate 39. Second display-panel support 252 is configured to provide means for supporting second display panel 250 in a reclined position relative to cover plate 39 wherein an upper edge of second display panel 250 lies in closer proximity to basin 32 of container 12 than a lower edge of second display panel 250 to cause second display panel 250 to cooperate with the upwardly facing top surface of cover plate to define an acute included angle therebetween when rim 40 of lid 16 is mated with brim 30 of the container 12 so that second printed message 27 provided on an inclined exterior surface 26 of second display panel 250 arranged to face away from cover plate 39 is visible to an observer as suggested in FIGS. 3 and 4.

Lid mount 18 is coupled to lower edge 50L of display panel 50, a lower edge of first fender 41, a lower edge of second display panel 250, and a lower edge of second fender 42 as suggested in FIG. 3. Lid mount 18 is configured to mate with brim 30 and lie in spaced-apart relation to basin 32 while an interior surface of each of first display panel 50 and second display panel 250 engages brim 30 of container 12 to retain cover plate 39 in a stationary position on container 12 closing the mouth defined by brim 30.

Figure 5:
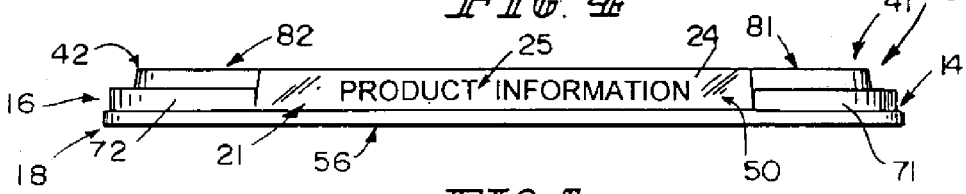
FIG. 5 is a front elevation view of the lid of FIG. 4 showing the forwardly facing display panel of the front message board.
Figure 6:
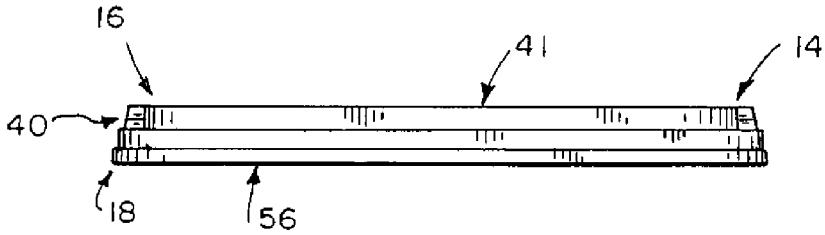
FIG. 6 is a right-side elevation view of the lid of FIGS. 4 and 5.

First fender 41 includes an outwardly extending first support segment 71 arranged to mate with brim 30 of container 12 and a first basin-stacking skirt 81 coupled to first support segment 71 as suggested in FIGS. 3, 4, and 8. First basin-stacking skirt 81 is arranged to extend upwardly away from cover plate 39 and first support segment 71 as suggested in FIG. 3. A portion of lid mount 18 is coupled to an outer edge of first support segment 71 as suggested in FIGS. 3, 5 and 6.

Second fender 42 includes an outwardly extending second support segment 72 arranged to mate with brim 30 of container 12 and a second basin-stacking skirt 82 coupled to second support segment 72 as suggested in FIGS. 3, 4, and 8. Another portion of lid mount 18 is coupled to an outer edge of second support segment 72 as suggested in FIGS. 3 and 5. Second basin-stacking skirt 82 is arranged to extend upwardly from the cover plate 39 as suggested in FIG. 3. Second basin-stacking skirt 82 cooperates with cover plate 39 and second support segment 72 and first basin-stacking skirt 81 to define means for defining a receptacle 83 sized to receive therein a basin 32 of an overlying canister (e.g., 10') to align overlying canister 10' in a predetermined stacked position on cover plate 39 of lid 16 in canister 10 as suggested in FIGS. 1 and 2.

First message board 21 includes a body 66 comprising display panel 50 and display-panel support 52 and a first arm 68 arranged to lie at an angle to body 66 and interconnect body 66 and first basin-stacking skirt 81. Display-panel support 52 includes an inner panel 62 coupled to first section 391 of the perimeter portion of cover plate 39 and a top panel 64 arranged to interconnect upper edge 50U of display panel 50 and upper edge of inner panel 62.

Figure 9:
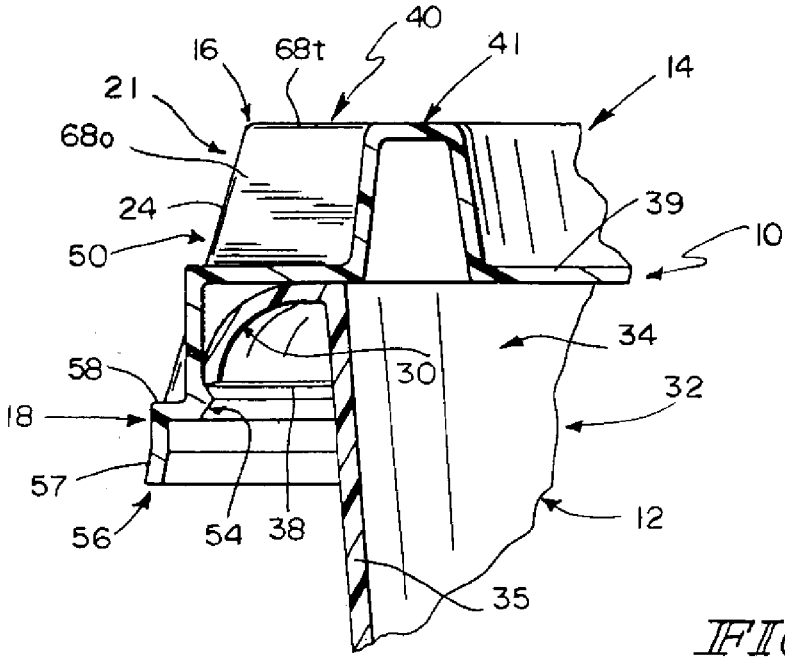
FIG. 9 is an enlarged sectional view taken along line 9-9 of FIG. 1.
Figure 10:
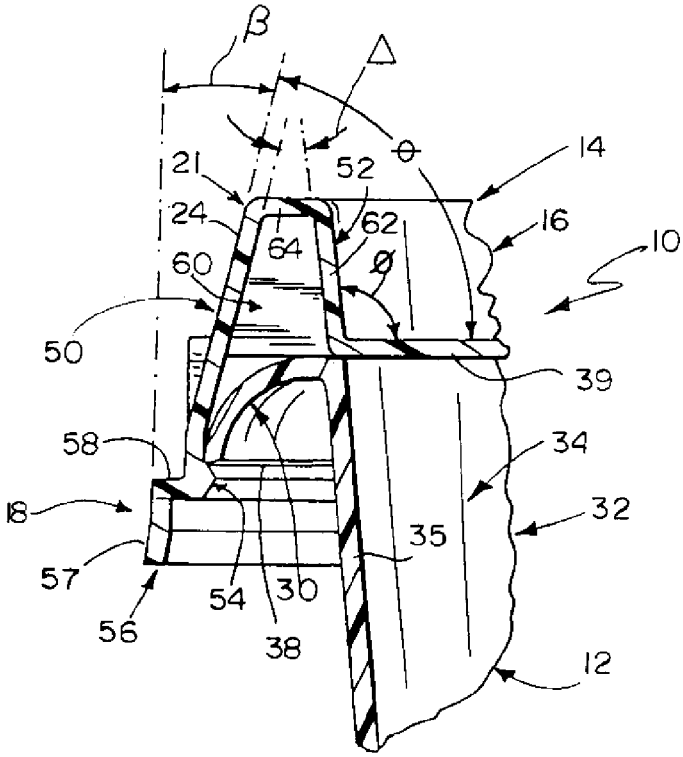
FIG. 10 is an enlarged sectional view taken along line 10-10 of FIG. 1.

First arm 68 is coupled to first support segment 71 and to first basin-stacking skirt 81 as suggested in FIGS. 1, 3, and 4. First arm 68 is formed to include an upwardly facing top wall **68*t* that is arranged to lie in generally coplanar relation to top panel 64 of display-panel support 52 as shown, for example, in FIG. 11. First arm 68 further includes an outer wall 68*o* coupled to first support segment 71 and to display panel 50, an inner wall 50*i* coupled to cover plate 39 and to inner panel 62 of the display-panel support 52, and a rigidifying web 93 coupled to the inner, outer, and top walls 68*i*, 68*o*, 68*t* included in first arm 68 as suggested in FIGS. 4, 9, and 12. Rigidifying web 93 is located in a downwardly opening chamber 601 defined by inner, outer, and top walls 68*i*, 68*o*, 68*t* of first arm 68 as shown, for example, in FIG. 7**.

Each of first and second support segments 71, 72 is C-shaped in an illustrative embodiment as suggested in FIG. 4. Each of the first and second basin-stacking skirts 81, 82 is C-shaped as also suggested in FIG. 4. First message board 21 includes a first arm 68 coupled to first basin-stacking skirt 81, a second arm 69 coupled to second basin-stacking skirt 82, and a body 66 comprising display panel 50 and display-panel support 52 and interconnecting first and second arms 68, 69 to provide first message board 21 with a C-shaped configuration first and second arms 68, 69 are arranged to lie in spaced-apart substantially parallel relation to one another as suggested in FIG. 4.

In an illustrative embodiment, as shown for example, in FIG. 7, lid 16 is formed to include an endless channel 90 on the underside thereof and eight rigidifying webs 91-98 located in channel 90. Rigidifying webs 91-98 are arranged to lie in spaced-apart relation to one another and configured to rigidify lid 16.

Channel 90 comprises, in series, downwardly opening chambers formed in first message board 21, first basin-stacking skirt 81 of first fender 41, second message board 22, and second basin-stacking skirt 82 of second fender 42 as shown, for example, in FIG. 7. For example, first message board 21 includes a downwardly opening chamber 60 formed in body 66, a downwardly opening chamber 601 formed in first arm 68 and arranged to communicate with a downwardly opening chamber 810 formed in first basin-stacking skirt 81, and a downwardly opening chamber 602 formed in second arm 68 and arranged to communicate with a downwardly opening chamber 820 formed in second basin-stacking skirt 82.

Display panel 50 and display-panel support 52 cooperate to form a downwardly opening chamber 60 in body 66 as suggested in FIGS. 2 and 7. Rim 40 further includes a body-rigidifying web 92 located in downwardly opening chamber 60 and coupled to display panel 50 and display-panel support 52. A first arm-rigidifying web 93 is located in downwardly opening chamber 601 formed in first arm 68 and coupled to each of the inner, top, and outer walls 68*i*, 68*t*, 68*o* of first arm. 68. A second arm-rigidifying web 91 is located in downwardly opening chamber 602 formed in second arm 69 and coupled to each of the inner, top, and outer walls of second arm 68.

The invention claimed is:

1. A canister comprising a container including a brim and a basin coupled to the brim and configured to form an interior product-storage region, the brim being formed to define a mouth opening into the interior product-storage region, and a lid including a cover plate and a rim coupled to a perimeter portion of the cover plate and configured to mate with the brim of the container to close the mouth defined by the brim and to cause a bottom surface of the cover plate to face downwardly toward the basin and a top surface of the cover plate to face upwardly away from the basin, wherein the rim includes a first message board extending along a first section of the perimeter portion of the cover plate and including a display panel arranged to lie in spaced-apart relation to the first section of the perimeter portion of the cover plate and a display-panel support coupled to the display panel and to the cover plate and configured to provide means for supporting the display panel in a reclined position relative to the cover plate wherein an upper edge of the display panel lies in closer proximity to the basin of the container than a lower edge of the display panel to cause the display panel to cooperate with the top surface of the cover plate to define an acute included angle therebetween when the rim of the lid is mated with the brim of the container so that a printed message provided on an inclined exterior surface of the display panel arranged to face away from the cover plate is visible to an observer, wherein the display-panel support further includes an inner panel and a top panel, the top panel arranged to interconnect the upper edge of the display panel and an upper edge of the inner panel, the top panel further arranged to cooperate with the display and inner panels to define a downwardly opening chamber, the brim extending upwardly into the downwardly opening chamber to lie in spaced-apart relation to the top panel when the rim of the lid is mated to the brim of the container, the rim further including a rigidifying web located in the downwardly opening chamber and coupled to the display panel and to the top panel and the inner panel of the display-panel support.

2. The canister of claim 1, further comprising a lid mount coupled to the lower edge of the display panel and configured to mate with the brim and lie in spaced-apart relation to the basin of the container while an interior surface of the display panel arranged to face toward the basin engages the brim of the container to retain the cover plate in a stationary position on the container closing the mouth defined by the brim.

3. The canister of claim 2, wherein the lid mount includes a lid-removal blocker wall coupled to the lower edge of the display panel and arranged to extend toward the basin of the container to lie under and mate with a downwardly facing terminal end of the brim.

4. The canister of claim 3, wherein the lid mount further includes a lid-removal flange coupled to the lid-removal blocker wall and arranged to extend downwardly away from the display panel and configured to include a downwardly extending, outwardly facing side wall oriented to cooperate with the inclined exterior surface of the display panel carrying the printed message to define an acute included angle therebetween and to include an outwardly extending, upwardly facing top wall oriented to cooperate with the inclined exterior surface of the display panel to define an obtuse included angle therebetween.

5. The canister of claim 2, wherein the brim is arranged to lie in a space provided under the display panel and between the lid mount and the first section of the perimeter portion of the cover plate when the rim of the lid is mated with the brim of the container.

6. The canister of claim 1, wherein the inner panel is coupled to the first section of the perimeter portion of the cover plate and arranged to lie in laterally spaced-apart relation to the display panel in an inclined position to cause the display panel and the inner panel to cooperate to form an acute included angle therebetween.

7. The canister of claim 6, wherein the inner panel is arranged to cooperate with the cover plate to form an obtuse included angle therebetween.

8. The canister of claim 6, wherein each of the display and inner panels are bow-shaped along lengths thereof to cause the inclined exterior surface of the display panel to have a convex shape facing away from the cover plate and the inner panel to have an exterior surface facing away from the display panel and having a concave shape.

9. The canister of claim 1, wherein the rigidifying web is arranged to lie above the brim when the rim of the lid is mated to the brim of the container.

10. The canister of claim 1, wherein the rim further includes a first fender coupled to a second section of the perimeter portion and a second fender coupled to a fourth section of the perimeter portion and the first message board is arranged to interconnect the first and second fenders.

11. The canister of claim 10, wherein each of the first and second fenders has a first end and an opposite second end, the first message board is coupled to the first end of each of the first and second fenders, and the rim further includes a second message board coupled to the second end of each of the first and second fenders and arranged to lie in spaced-apart relation to the first message board to locate the cover plate therebetween.

12. The canister of claim 11, wherein the second message board is arranged to extend along a third section of the perimeter portion of the cover plate, the second message board includes a second display panel arranged to lie in spaced-apart relation to the third section of the perimeter portion and a second display-panel support coupled to the second display panel and to the cover plate and configured to provide means for supporting the second display panel in a reclined position relative to the cover plate wherein an upper edge of the second display panel lies in closer proximity to the basin of the container than a lower edge of the second display panel to cause the second display panel to cooperate with the top surface of the cover plate to define an acute included angle therebetween when the rim of the lid is mated with the brim of the container so that a second printed message provided on an inclined exterior surface of the second display panel arranged to face away from the cover plate is visible to an observer.

13. The canister of claim 12, further comprising a lid mount coupled to the lower edge of the display panel, a lower edge of the first fender, the lower edge of the second display panel, and a lower edge of the second fender, and the lid mount is configured to mate with the brim and lie in spaced-apart relation to the basin while an interior surface of each of the display panel and the second display panel engages the brim of the container to retain the cover plate in a stationary position on the container closing the mouth defined by the brim.

14. The canister of claim 10, wherein the first fender includes a first support segment arranged to mate with the brim and a first basin-stacking skirt coupled to the first support segment and arranged to extend upwardly away from the cover plate and the second fender includes a second support segment arranged to mate with the brim and a second basin-stacking skirt coupled to the second support segment and arranged to extend upwardly from the cover plate and to cooperate with the cover plate and the first basin-stacking skirt to define means for defining a receptacle sized to receive therein a basin of an overlying canister to align the overlying canister in a predetermined stacked position on the cover plate.

15. A canister comprising a container including a brim and a basin coupled to the brim and configured to form an interior product-storage region, the brim being formed to define a mouth opening into the interior product-storage region, and a lid including a cover plate and a rim coupled to a perimeter portion of the cover plate and configured to mate with the brim of the container to close the mouth defined by the brim and to cause a bottom surface of the cover plate to face downwardly toward the basin and a top surface of the cover plate to face upwardly away from the basin, wherein the rim includes a first message board extending along a first section of the perimeter portion of the cover plate and including a display panel arranged to lie in spaced-apart relation to the first section of the perimeter portion of the cover plate and a display-panel support coupled to the display panel and to the cover plate and configured to provide means for supporting the display panel in a reclined position relative to the cover plate wherein an upper edge of the display panel lies in closer proximity to the basin of the container than a lower edge of the display panel to cause the display panel to cooperate with the top surface of the cover plate to define an acute included angle therebetween when the rim of the lid is mated with the brim of the container so that a printed message provided on an inclined exterior surface of the display panel arranged to face away from the cover plate is visible to an observer, wherein the rim further includes a first fender coupled to a second section of the perimeter portion and a second fender coupled to a fourth section of the perimeter portion and the first message board is arranged to interconnect the first and second fenders, wherein each of the first and second fenders has a first end and an opposite second end, the first message board is coupled to the first end of each of the first and second fenders, and the rim further includes a second message board coupled to the second end of each of the first and second fenders and the second message board is arranged to lie in spaced-apart relation to the first message board to locate the cover plate therebetween, and wherein the cover plate includes a first generally D-shaped section coupled to the first fender, a second generally D-shaped section coupled to the second fender, and a generally rectangular section coupled to each of the first and second message boards and arranged to lie between and interconnect the first and second generally D-shaped sections.

16. A canister comprising a container including a brim and a basin coupled to the brim and configured to form an interior product-storage region, the brim being formed to define a mouth opening into the interior product-storage region, and a lid including a cover plate and a rim coupled to a perimeter portion of the cover plate and configured to mate with the brim of the container to close the mouth defined by the brim and to cause a bottom surface of the cover plate to face downwardly toward the basin and a top surface of the cover plate to face upwardly away from the basin, wherein the rim includes a first message board extending along a first section of the perimeter portion of the cover plate and including a display panel arranged to lie in spaced-apart relation to the first section of the perimeter portion of the cover plate and a display-panel support coupled to the display panel and to the cover plate and configured to provide means for supporting the display panel in a reclined position relative to the cover plate wherein an upper edge of the display panel lies in closer proximity to the basin of the container than a lower edge of the display panel to cause the display panel to cooperate with the top surface of the cover plate to define an acute included angle therebetween when the rim of the lid is mated with the brim of the container so that a printed message provided on an inclined exterior surface of the display panel arranged to face away from the cover plate is visible to an observer, wherein the rim further includes a first fender coupled to a second section of the perimeter portion and a second fender coupled to a fourth section of the perimeter portion and the first message board is arranged to interconnect the first and second fenders, wherein the first fender includes a first support segment arranged to mate with the brim and a first basin-stacking skirt coupled to the first support segment and arranged to extend upwardly away from the cover plate and the second fender includes a second support segment arranged to mate with the brim and a second basin-stacking skirt coupled to the second support segment and arranged to extend upwardly from the cover plate and to cooperate with the cover plate and the first basin-stacking skirt to define means for defining a receptacle sized to receive therein a basin of an overlying canister to align the overlying canister in a predetermined stacked position on the cover plate, and wherein the first message board includes a body comprising the display panel and the display-panel support and a first arm arranged to lie at an angle to the body and interconnect the body and the first basin-stacking skirt.

17. The canister of claim 16, wherein the display-panel support includes an inner panel coupled to the first section of the perimeter portion of the cover plate and a top panel arranged to interconnect the upper edge of the display panel and an upper edge of the inner panel and the first arm is coupled to the first support segment and formed to include an upwardly facing top wall that is arranged to lie in generally coplanar relation to the top panel of the display-panel support.

18. The canister of claim 17, wherein the first arm further includes an outer wall coupled to the first support segment and to the display panel, an inner wall coupled to the cover plate and to the inner panel of the display-panel support, and a rigidifying web coupled to the inner, outer, and top walls included in the first arm and located in a downwardly opening chamber defined by the inner, outer, and top walls of the first arm.

19. A canister comprising a container including a brim and a basin coupled to the brim and configured to form an interior product-storage region, the brim being formed to define a mouth opening into the interior product-storage region, and a lid including a cover plate and a rim coupled to a perimeter portion of the cover plate and configured to mate with the brim of the container to close the mouth defined by the brim and to cause a bottom surface of the cover plate to face downwardly toward the basin and a top surface of the cover plate to face upwardly away from the basin, wherein the rim includes a first message board extending along a first section of the perimeter portion of the cover plate and including a display panel arranged to lie in spaced-apart relation to the first section of the perimeter portion of the cover plate and a display-panel support coupled to the display panel and to the cover plate and configured to provide means for supporting the display panel in a reclined position relative to the cover plate wherein an upper edge of the display panel lies in closer proximity to the basin of the container than a lower edge of the display panel to cause the display panel to cooperate with the top surface of the cover plate to define an acute included angle therebetween when the rim of the lid is mated with the brim of the container so that a printed message provided on an inclined exterior surface of the display panel arranged to face away from the cover plate is visible to an observer, wherein the rim further includes a first fender coupled to a second section of the perimeter portion and a second fender coupled to a fourth section of the perimeter portion and the first message board is arranged to interconnect the first and second fenders, wherein the first fender includes a first support segment arranged to mate with the brim and a first basin-stacking skirt coupled to the first support segment and arranged to extend upwardly away from the cover plate and the second fender includes a second support segment arranged to mate with the brim and a second basin-stacking skirt coupled to the second support segment and arranged to extend upwardly from the cover plate and to cooperate with the cover plate and the first basin-stacking skirt to define means for defining a receptacle sized to receive therein a basin of an overlying canister to align the overlying canister in a predetermined stacked position on the cover plate, and wherein each of the first and second support segments is C-shaped, each of the first and second basin-stacking skirts is C-shaped, and the first message board includes a first arm coupled to the first basin-stacking skirt, a second arm coupled to the second basin-stacking skirt, and a body comprising the display panel and the display-panel support and interconnecting the first and second arms to provide the first message board with a C-shaped configuration.

20. The canister of claim 19, wherein the display panel and the display-panel support cooperate to form a downwardly opening chamber in the body, the rim further includes a body-rigidifying web located in the downwardly opening chamber and coupled to the display panel and the display-panel support, the first arm includes an outer wall coupled to the display panel, first support segment, and first basin-stacking skirt, an inner wall coupled to the display-panel support, cover plate, and first basin-stacking skirt, a top wall cooperating with and interconnecting the inner and outer walls of the first arm to form a downwardly opening chamber in the first arm, and a first arm-rigidifying web located in the downwardly opening chamber formed in the first arm and coupled to each of the inner, top, and outer walls of the first arm, and the second arm includes an outer wall coupled to the display panel, second support segment, and second basin-stacking skirt, an inner wall coupled to the display-panel support, cover plate, and second basin-stacking skirt, a top wall cooperating with and interconnecting the inner and outer walls of the second arm to form a downwardly opening chamber in the second arm, and a second arm-rigidifying web located in the downwardly opening chamber formed in the second arm and coupled to each of the inner, top, and outer walls of the second arm.

21. A canister comprising a container including a brim and a basin coupled to the brim and configured to form an interior product-storage region, the brim being formed to define a mouth opening into the interior product-storage region, a lid including a cover plate and a rim coupled to a perimeter portion of the cover plate and configured to mate with the brim of the container to close the mouth defined by the brim, wherein the rim includes, in series, a first message board coupled to a first section of the perimeter portion, a first fender coupled to a second section of the perimeter portion, a second message board coupled to a third section of the perimeter portion to locate the cover plate therebetween, and a second fender coupled to a fourth section of the perimeter portion and arranged to lie in spaced-apart relation to the first fender to locate the cover plate therebetween, the first message board includes a display panel oriented to lie in a positively sloping direction relative to the cover plate and formed to include an inclined exterior surface facing away from the cover plate and carrying a printed message thereon, and the second message board includes a second display panel oriented to lie in a negatively sloping direction relative to the cover plate and formed to include an inclined exterior surface facing away from the cover plate and the display panel of the first message board and carrying a printed message thereon, wherein each of the first and second message boards and the first and second fenders is C-shaped, the first message board interconnects first ends of each of the first and second fenders, and the second message board interconnects second ends of each of the first and second fenders.

* * * * *